US011484883B2

(12) United States Patent
Cho et al.

(10) Patent No.: US 11,484,883 B2
(45) Date of Patent: Nov. 1, 2022

(54) MICROFLUIDIC DEVICE

(71) Applicants: UNIST (ULSAN NATIONAL INSTITUTE OF SCIENCE AND TECHNOLOGY), Ulsan (KR); CLINOMICS CO., Ulsan (KR)

(72) Inventors: Yoon Kyoung Cho, Ulsan (KR); Tae-Hyeong Kim, Ulsan (KR); Kyusang Lee, Ulsan (KR); Heechul Park, Ulsan (KR)

(73) Assignees: UNIST (ULSAN NATIONAL INSTITUTE OF SCIENCE AND TECHNOLOGY), Ulsan (KR); CLINOMICS CO., Ulsan (KR)

( * ) Notice: Subject to any disclaimer, the term of this patent is extended or adjusted under 35 U.S.C. 154(b) by 275 days.

(21) Appl. No.: 16/310,529

(22) PCT Filed: Dec. 13, 2016

(86) PCT No.: PCT/KR2016/014590
§ 371 (c)(1),
(2) Date: Dec. 17, 2018

(87) PCT Pub. No.: WO2017/222127
PCT Pub. Date: Dec. 28, 2017

(65) Prior Publication Data

US 2019/0366341 A1 Dec. 5, 2019

(30) Foreign Application Priority Data

Jun. 21, 2016 (KR) ..... 10-2016-0077381

(51) Int. Cl.
*B01L 3/00* (2006.01)

(52) U.S. Cl.
CPC . *B01L 3/502753* (2013.01); *B01L 2200/0647* (2013.01); *B01L 2200/141* (2013.01);
(Continued)

(58) Field of Classification Search
CPC ..... B01L 2300/0861; B01L 2300/12; B01L 2200/141; B01L 2300/0832;
(Continued)

(56) References Cited

U.S. PATENT DOCUMENTS

2003/0152491 A1* 8/2003 Kellogg ..... B01F 13/0059 422/400
2005/0048597 A1 3/2005 Smith et al.
(Continued)

FOREIGN PATENT DOCUMENTS

CN 101517413 8/2009
CN 103537329 1/2014
(Continued)

OTHER PUBLICATIONS

EPO, Supplementary European Search Report of EP 16906402.9 dated Apr. 3, 2020.
(Continued)

*Primary Examiner* — Rebecca M Fritchman
(74) *Attorney, Agent, or Firm* — Lex IP Meister, PLLC

(57) ABSTRACT

The present invention may provide a microfluidic device including a rotatable body; a first chamber positioned in a direction of an inner wall of the body; a second chamber positioned in a direction of an outer wall of the body from the first chamber; and a backflow prevention unit, and wherein a fluid is transferred from the first chamber to the second chamber, and wherein the backflow prevention unit prevents a backflow of the fluid from the second chamber to the first chamber.

7 Claims, 11 Drawing Sheets

(52) U.S. Cl.
CPC . *B01L 2300/069* (2013.01); *B01L 2300/0681* (2013.01); *B01L 2300/0803* (2013.01); *B01L 2300/0832* (2013.01); *B01L 2300/0858* (2013.01); *B01L 2300/0861* (2013.01); *B01L 2300/12* (2013.01); *B01L 2400/0409* (2013.01)

(58) Field of Classification Search
CPC ..... B01L 2300/0858; B01L 3/00; B01L 2300/0681; B01L 2300/0803; B01L 2400/0409; B01L 2300/069; B01L 3/502753; B01L 2200/0647; G01N 35/08
See application file for complete search history.

(56) References Cited

U.S. PATENT DOCUMENTS

| | | | | |
|---|---|---|---|---|
| 2005/0095172 | A1 | 5/2005 | Nagaoka et al. | |
| 2007/0003437 | A1 | 1/2007 | Ozaki et al. | |
| 2010/0050751 | A1* | 3/2010 | Lee ..... | G01N 35/00029 73/863 |
| 2010/0233033 | A1 | 9/2010 | Horiuchi et al. | |
| 2012/0178179 | A1* | 7/2012 | Kim ..... | B01L 3/502738 436/180 |
| 2014/0038209 | A1 | 2/2014 | Shih et al. | |
| 2014/0147862 | A1 | 5/2014 | Kim et al. | |
| 2015/0314290 | A1 | 11/2015 | Cho et al. | |
| 2019/0191643 | A1 | 6/2019 | Chan et al. | |

FOREIGN PATENT DOCUMENTS

| | | |
|---|---|---|
| CN | 103543104 | 1/2014 |
| CN | 103566984 | 2/2014 |
| EP | 1916524 | 4/2008 |
| JP | 3091964 | 2/2003 |
| JP | 2003-533681 | 11/2003 |
| JP | 2005-345160 | 12/2005 |
| JP | 2007-033225 | 2/2007 |
| JP | 2010-025645 | 2/2010 |
| JP | 2014-103966 | 6/2014 |
| JP | 2019-520343 | 7/2019 |
| KR | 10-2010-0027389 | 3/2010 |
| KR | 10-2012-0091631 | 8/2012 |
| KR | 10-1347373 | 1/2014 |
| KR | 10-2014-0071222 | 6/2014 |
| KR | 10-2014-0092496 | 7/2014 |
| KR | 10-2015-0045816 | 4/2015 |
| KR | 10-2015-0125336 | 11/2015 |
| WO | 2003-059484 | 7/2003 |
| WO | 2006-077695 | 7/2006 |
| WO | 2008-001737 | 1/2008 |
| WO | 2010-013704 | 2/2010 |

OTHER PUBLICATIONS

JPO, Office Action of JP 2019-520343 dated Jan. 6, 2020.
EPO, Supplementary Partial European Search Report of 16906402.9 dated Nov. 19, 2019.

* cited by examiner

MICROFLUIDIC DEVICE

TECHNICAL FIELD

The present invention relates to a microfluidic device, and more particularly to a microfluidic device including a structure for preventing backflow of a filtered microfluid.

BACKGROUND ART

Circulating tumor cells (CTC) are separated from primary carcinomas of cancer patients and circulate in the blood vessels, generate new blood vessels at any point and cause cancer metastasis. This is a key factor in cancer metastasis, and has attracted much attention in the field of cancer metastasis therapeutic research. The primary goal of the research field is to isolate CTCs and identify genetic information from them. This is to predict which metastasis CTC can cause and to make a customized diagnosis accordingly.

However, the concentration of CTC in the blood is low, making it difficult to separate. Only a few CTCs are present in 1 mL of blood and are extremely low in concentration compared to other blood cells with more than one billion blood cells. Therefore, in order to obtain a significant number of CTCs for diagnosis, a large amount of blood of several milliliters is required, and it is necessary to develop a technology for selectively separating CTC from a number of blood cells. Numerous studies are underway for this purpose.

A representative research field for selectively separating CTCs is size-based CTC separation. Generally, CTC has larger diameter than other blood cells. Using these features, CTC can be selectively isolated from a number of blood cells through blood filtration. However, as mentioned above, to separate a significant number of CTCs for diagnosis requires several milliliters of blood filtration, which requires a fluid device with a large volume.

On a microfluidic device, there is a limit to handling a few milliliters of blood, and even if it is designed to be a large volume, the already filtered blood can backflow and contaminate the filtration membrane. This can lead to inaccurate results. Therefore, in order to handle a large volume of blood, it is essential to secure a technology to effectively prevent backflow and store the filtered waste blood.

DISCLOSURE

Technical Problem

The present invention has been made in an effort to provide a microfluidic device having advantages of preventing backflow of filtrated microfluid and thus contamination in the device by including a filtration prevention unit having a specific structure.

Technical Solution

An exemplary embodiment of the present invention provides a microfluidic device including a rotatable body; a first chamber positioned in a direction of an inner wall of the body; a second chamber positioned in a direction of an outer wall of the body from the first chamber; and a backflow prevention unit, and wherein a fluid is transferred from the first chamber to the second chamber, and wherein the backflow prevention unit prevents a backflow of the fluid from the second chamber to the first chamber.

The backflow prevention unit may include a moisture absorbent positioned in the second chamber and capable of absorbing a filtered fluid.

The second chamber may have a shape having at least one end portion protruding toward a center of the body, and include the moisture absorbent in the end portion of the second chamber such that a moisture absorption is possible in a direction opposite to a centrifugal force.

The moisture absorbent may be in the form of powder.

The moisture absorbent may be fixed to a support.

In the second chamber, the moisture absorbent fixed to the support may be stacked.

The support may include polyethylene, polyester, nylon or a combination thereof.

The moisture absorbent may include natural fibers, acrylonitrile, silica gel, calcium chloride, acrylamide, or combinations thereof.

The body may be a cylindrical structure rotatable with respect to a center

The second chamber may include an air hole connected to outside air.

The fluid may include blood, urine, saliva, or a combination thereof.

The backflow prevention unit may include a first micro flow channel and a second micro flow channel sequentially positioned between the first chamber and the second chamber, wherein the second micro flow channel has a shape in which a direction in which the fluid flows in from the first micro flow channel to the second micro flow channel and a direction in which the fluid flows out from the second micro flow channel to the second chamber are different with respect to a flow direction of the fluid, and wherein a wall having no permeability to the fluid is positioned between the second micro flow channel and the second chamber.

In the second micro flow channel, an angle formed by the direction in which the fluid flows in from the first micro flow channel to the second micro flow channel and the direction in which the fluid flows out from the second micro flow channel to the second chamber may be more than 0° and less than or equal to 180°.

A length of the second micro flow channel may be equal to or more than 10 mm and equal to or less than 50 mm.

A length of the wall may be equal to or more than 0.5 mm and equal to or less than 50 mm.

A diameter of the second micro flow channel may be equal to or more than 0.01 mm and equal to or less than 100 mm.

The microfluidic device may further include a third chamber positioned in a direction of the center of the body from the second chamber and connected to the second chamber.

The third chamber may further include a structure, at one end portion to which the third chamber and the second chamber are connected, protruding in a direction of the inside of the third chamber.

The fluid may include blood, urine, saliva, or a combination thereof.

The backflow prevention unit may include a fourth chamber positioned between the first chamber and the second chamber and blocked from outside air; a third micro flow channel positioned between the first chamber and the fourth chamber; and a fourth micro flow channel positioned between the fourth chamber and the second chamber.

The fourth chamber may be in the form of a column in a direction perpendicular to a fluid flow direction in the third micro flow channel and the fourth micro flow channel.

The fourth chamber in the form of the column may have a thickness of more than 0 mm, and equal to or less than 10 mm.

The second chamber may include an air hole connected to outside air.

A diameter of the third micro flow channel may be equal to or more than 0.01 mm and equal to or less than 100 mm.

A diameter of the fourth micro flow channel may be equal to or more than 0.01 mm and equal to or less than 100 mm.

The fluid may include blood, urine, saliva, or a combination thereof.

In addition, the second chamber may include a moisture absorbent capable of absorbing a fluid filtered in the first chamber The second chamber may have a shape having at least one end portion protruding toward a center of the body, and include the moisture absorbent in the end portion of the second chamber such that a moisture absorption is possible in a direction opposite to a centrifugal force.

The microfluidic device may further include a second micro flow channel positioned between the fourth micro flow channel and the second chamber and connecting the fourth micro flow channel and the second chamber wherein the second micro flow channel has a shape in which a direction in which the fluid flows in from the fourth micro flow channel to the second micro flow channel and a direction in which the fluid flows out from the second micro flow channel to the second chamber are different with respect to a flow direction of the fluid, and wherein a wall having no permeability to the fluid is positioned between the second micro flow channel and the second chamber.

In the second micro flow channel, an angle formed by the direction in which the fluid flows in from the fourth micro flow channel to the second micro flow channel and the direction in which the fluid flows out from the second micro flow channel to the second chamber may be equal to or more than 30°.

The microfluidic device may further include a third chamber positioned in a direction of the center of the body from the second chamber and connected to the second chamber.

The third chamber may include a structure, at one end portion to which the third chamber and the second chamber are connected, protruding in a direction of the inside of the third chamber.

According to an embodiment of the present invention, by including a backflow prevention unit of a specific structure, a microfluidic device capable of preventing backflow of filtered microfluid and thus contamination in the device may be provided.

MODE FOR INVENTION

Hereinafter, an embodiment of the present invention will be described in detail. It should be understood, however, that this is provided as an example, the present invention is not limited thereby, and the present invention is only defined by the scope of the claimed claims.

As described above, in isolating cells with very low concentrations in the blood, such as circulating tumor cells (CTC), in order to separate a sufficient amount of cells necessary for diagnosis, several milliliters of blood filtration is required, which necessitates a fluid device having a large volume.

However, on a conventional microfluidic device, there is a limit to handling a few milliliters of blood, and even if it is designed to be a large volume, the already filtered blood can backflow and contaminate the filtration membrane. This can lead to inaccurate results.

The present invention provides a microfluidic device having capable of preventing backflow of filtrated microfluid by including a backflow prevention unit on the microfluidic device and thus contamination of a filtration membrane.

Figure 1:
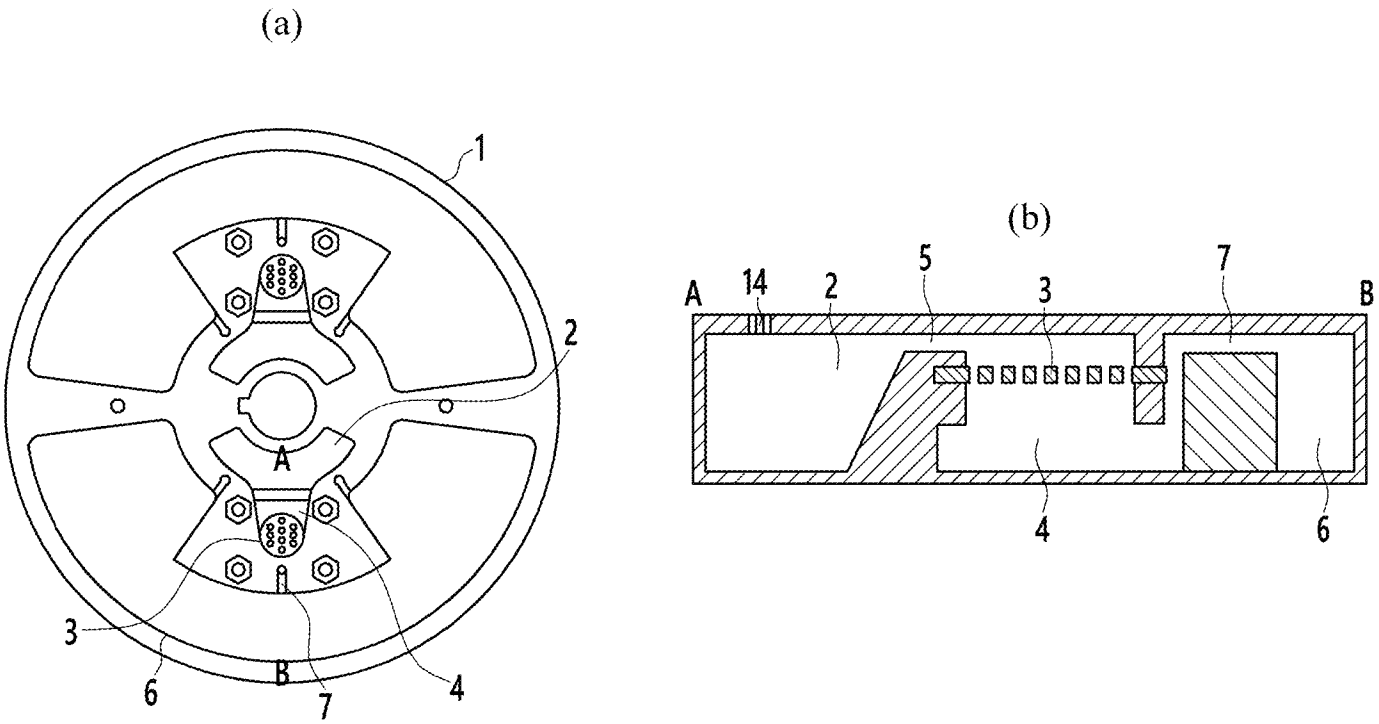
FIGS. 1A and 1B are respectively a cross-sectional view and a longitudinal cross-sectional view of a microfluidic device excluding a backflow prevention unit.

FIG. 1(*a*) is a cross-sectional view of a microfluidic device excluding a backflow prevention unit. FIG. 1(*b*) is a longitudinal cross-sectional view between a point A and a point B of the microfluidic device of FIG. 1(*a*).

An embodiment of the invention provides a microfluidic device including a rotatable body 1; a first chamber 2 located in a direction of an inner wall direction of the body 1; a second chamber 6 located in a direction of an outer wall of the body 1 from the first chamber 2; and the backflow prevention unit, wherein fluid is transferred from the first chamber 2 to the second chamber 6, and the backflow prevention unit prevents backflow of the fluid from the second chamber 6 in the first chamber 2.

In the microfluidic device, the fluid may be injected into the first chamber 2, and the microfluidic device may further include an injection port 14 for injecting fluid into the first chamber 2. The microfluidic device may include a filtration chamber 4 including a filtration membrane 3 for filtration of fluid such as blood between the first chamber 2 and the second chamber 6. Here, the microfluidic device may further include a fifth micro flow channel 5 through which blood may move between the filtration chamber 4 and the first chamber 2.

A more specific configuration of the microfluidic device excluding the backflow prevention unit may be referred to Korean patent application No. 10-2014-0052538, and the backflow prevention unit is described in detail in the present specification.

First Embodiment

Figure 2:
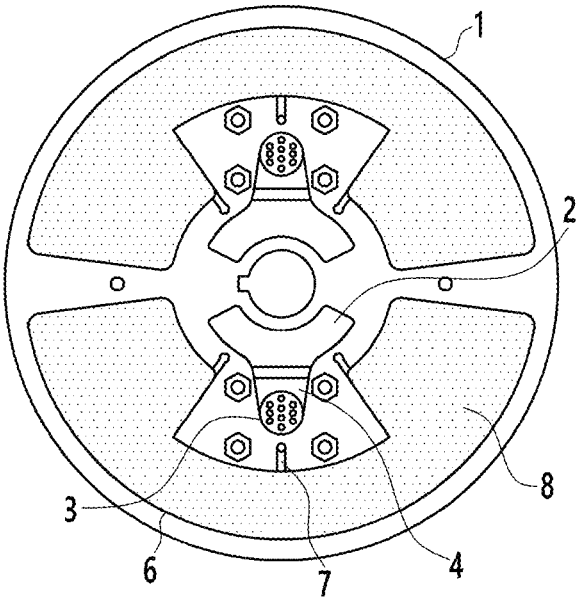
FIG. 2 is a cross-sectional view of a microfluidic device including a backflow prevention unit according to a first embodiment of the present invention

The backflow prevention unit of the first embodiment may include a moisture absorbent 8 located in the second chamber 6 and capable of absorbing filtered fluid. FIG. 2 is a cross-sectional view of a microfluidic device including a backflow prevention unit including a moisture absorbent.

The microfluidic device may be a rotatable structure with respect to the center of the device. Also, a shape of the structure may have various shapes such as a cylindrical shape, a square column shape, and the like. More preferably, the shape of the structure may be cylindrical.

Fluid injected into the first chamber 2 is transferred to the second chamber 6 by centrifugal force generated during rotation of the microfluidic device which is a rotatable structure with respect to the center. The transferred fluid enters into the second chamber 6 and simultaneously is absorbed by the moisture absorbent 8 in the second chamber 6.

Figure 3:
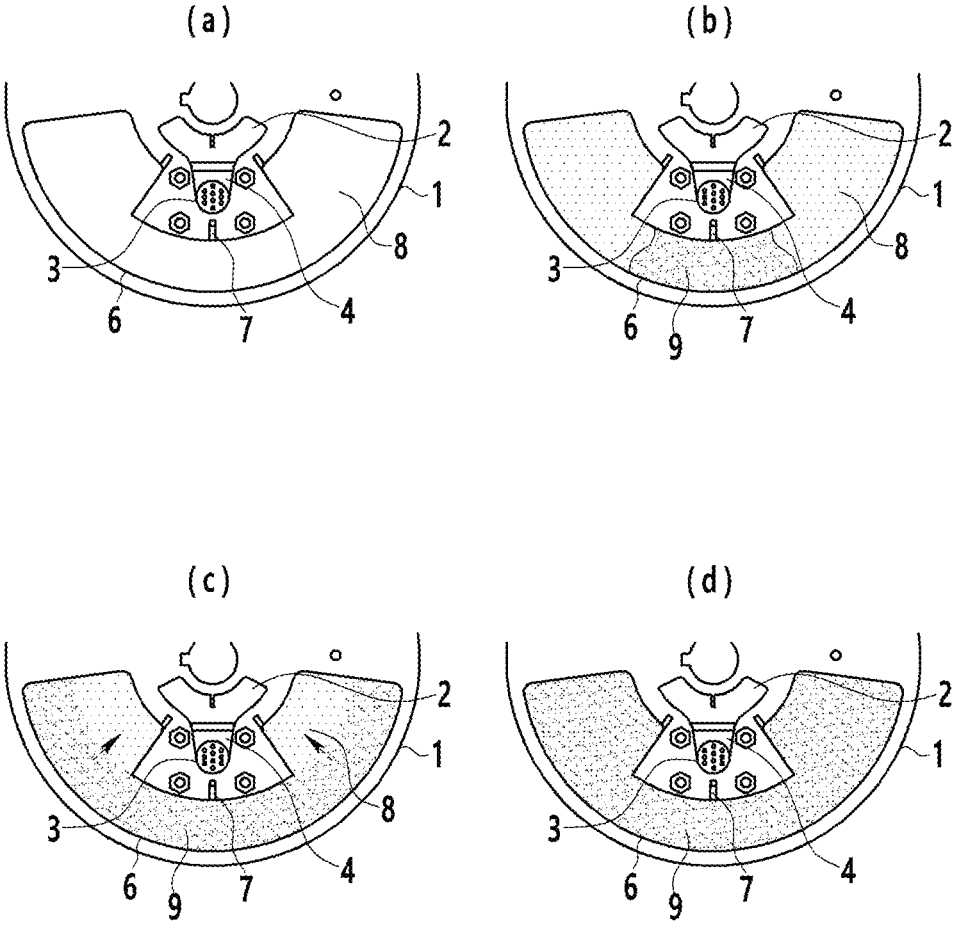
FIG. 3 is a schematic view illustrating an exemplary behavior of fluid in a microfluidic device including a backflow prevention unit according to a first embodiment of the present invention.

FIG. 3 shows an exemplary absorption pattern of transferred fluid by the moisture absorbent 8. The microfluidic device is maintained as shown in FIG. 3(*a*) before the fluid is transferred to the second chamber 6, and when fluid 9 is transferred to the second chamber 6 by the rotation of the device, as shown in FIGS. 3(*b*), (*c*), and (*d*), an absorption amount of the fluid 9 increases as an absorption region gradually widens.

A flow of the fluid 9 in the moisture absorbent 8 is limited only by diffusion into the moisture absorbent 8 by a capillary force. Therefore, it is possible to prevent backflow to the first chamber 2 even in a state where the microfluidic device is inclined.

Here, the second chamber 6 has a shape in which at least one end portion protrudes toward the center of the body, and the moisture absorbent 8 is also included in the end portion of the second chamber 6 and thus, it may be possible to absorb moisture in a direction opposite to centrifugal force Therefore, a movement of the fluid 9 in the moisture absorbent 8 may also act in the direction opposite to the centrifugal force action as shown in FIGS. 3 (*c*) and 3 (*d*). Therefore, it is possible to absorb moisture of the fluid 9 even at a position closer to the center of the microfluidic device than a position where the fluid enters the second chamber 6. Thus, absorption in a wider area is possible, and thus a space in the device may be efficiently used and an amount of filtered fluid that may be accommodated may increase.

The moisture absorber 8 in the second chamber 6 may be in the form of powder. By using the moisture absorbent 8 in the form of powder, a surface area in contact with the filtered fluid is increased, thereby maximizing the moisture absorption efficiency.

More specifically, the moisture absorbent 8 in the form of powder may be fixed to a support. A shape of the support may be variously adjusted as long as it is suitable for insertion into the second chamber 6, and, for example, may be a shape of a plate. By using the moisture absorbent 8 fixed to the support, transportation and application in a chamber may be facilitated as compared with a case of using in the form of powder itself.

More specifically, the support may be capable of being cut into a specific shape. Accordingly, the moisture absorber 8 in the second chamber 6 is fixed to the support and may be stacked in a plurality of layers and inserted into the chamber. Thus, the moisture absorbent 8 may be densely inserted into the second chamber 6, thereby maximizing an amount of moisture absorption and improving the fluid throughput of the microfluidic device.

The support may include polyethylene, polyester, nylon, or a combination thereof. The support of such a material is easy to fix the moisture absorbent 8. However, the present invention is not limited thereto, and other materials may be employed as long as the moisture absorbent 8 may be easily fixed.

The moisture absorbent 8 may include natural fibers, acrylonitrile, silica gel, calcium chloride, acrylamide, or a combination thereof. The moisture absorbent 8 made of such a material is excellent in absorbing ability to liquid and may be capable of absorbing 0.5 mL of liquid per volume of 1 $cm^3$. However, the present invention is not limited thereto, and other materials having excellent moisture absorption ability may be employed.

The second chamber 6 may include an air hole connected to the outside air, though not shown in the figure. Thus, a moving force of liquid in the moisture absorbent 8 is given such that absorption of the moisture absorbent 8 may be further facilitated.

The fluid 9 to be processed through the microfluidic device may include blood, urine, saliva, or a combination thereof.

Second Embodiment

Figure 4:
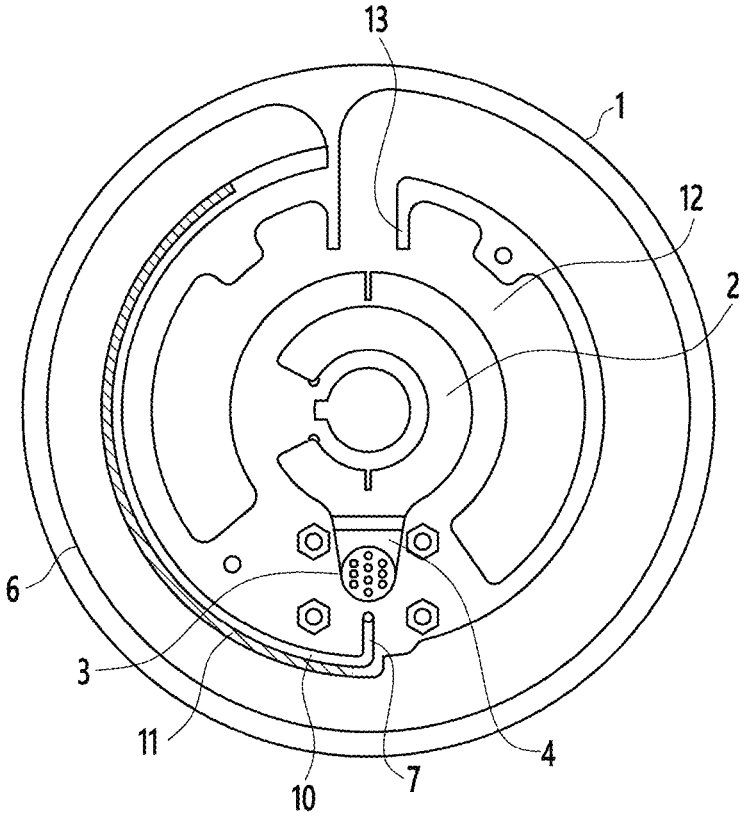
FIG. 4 is a cross-sectional view of a microfluidic device including a backflow prevention unit according to a second embodiment of the present invention

FIG. 4 is a cross-sectional view of a microfluidic device including a backflow prevention unit according to a second embodiment The backflow prevention unit of the second embodiment includes a first micro flow channel 7 and a second micro flow channel 10 sequentially positioned between the first chamber 2 and the second chamber 6. The second micro flow channel 10 has a shape in which a direction in which the fluid flows in from the first micro flow channel 7 to the second micro flow channel 10 and a direction in which the fluid flows out from the second micro flow channel 10 to the second chamber 6 are different with respect to a flow direction of the fluid. A wall 11 having no permeability to the fluid may be positioned between the second micro flow channel 10 and the second chamber 6.

The microfluidic device may be a rotatable structure with respect to the center of the device. Also, a shape of the structure may have various shapes such as a cylindrical shape, a square column shape, and the like. More preferably, the shape of the structure may be cylindrical.

The fluid injected into the first chamber 2 is transferred to the second chamber 6 through the first micro flow channel 7 and the second micro flow channel 10 by centrifugal force generated during rotation of the microfluidic device which is a rotatable structure with respect to the center.

The second chamber 6 may include an air hole connected to the outside air, though not shown in the figure. Thus, the moving force of the fluid from the first chamber 2 to the second chamber 6 is given, and the fluid may be smoothly conveyed.

When the fluid is transferred from the first chamber 2 to the second chamber 6, the fluid passes through the second micro flow channel 10 having a shape in which a direction in which the fluid flows in from the first micro flow channel 7 to the second micro flow channel 10 and a direction in which the fluid flows out from the second micro flow channel 10 to the second chamber 6 are different with respect to a flow direction of the fluid.

The wall 11 which has the same shape as the second micro flow channel 10 and is not permeable to the fluid may be positioned between the second micro flow channel 10 and the second chamber 6. After the fluid is transferred from the first chamber 2 to the second chamber 6 in the microfluidic device through the shape of the second micro flow channel 10 and the wall 11, even though the device is inclined due to an unexpected situation, the fluid filtered in a direction from the second chamber 6 to the first chamber 2 is prevented from flowing backward.

Figure 5:
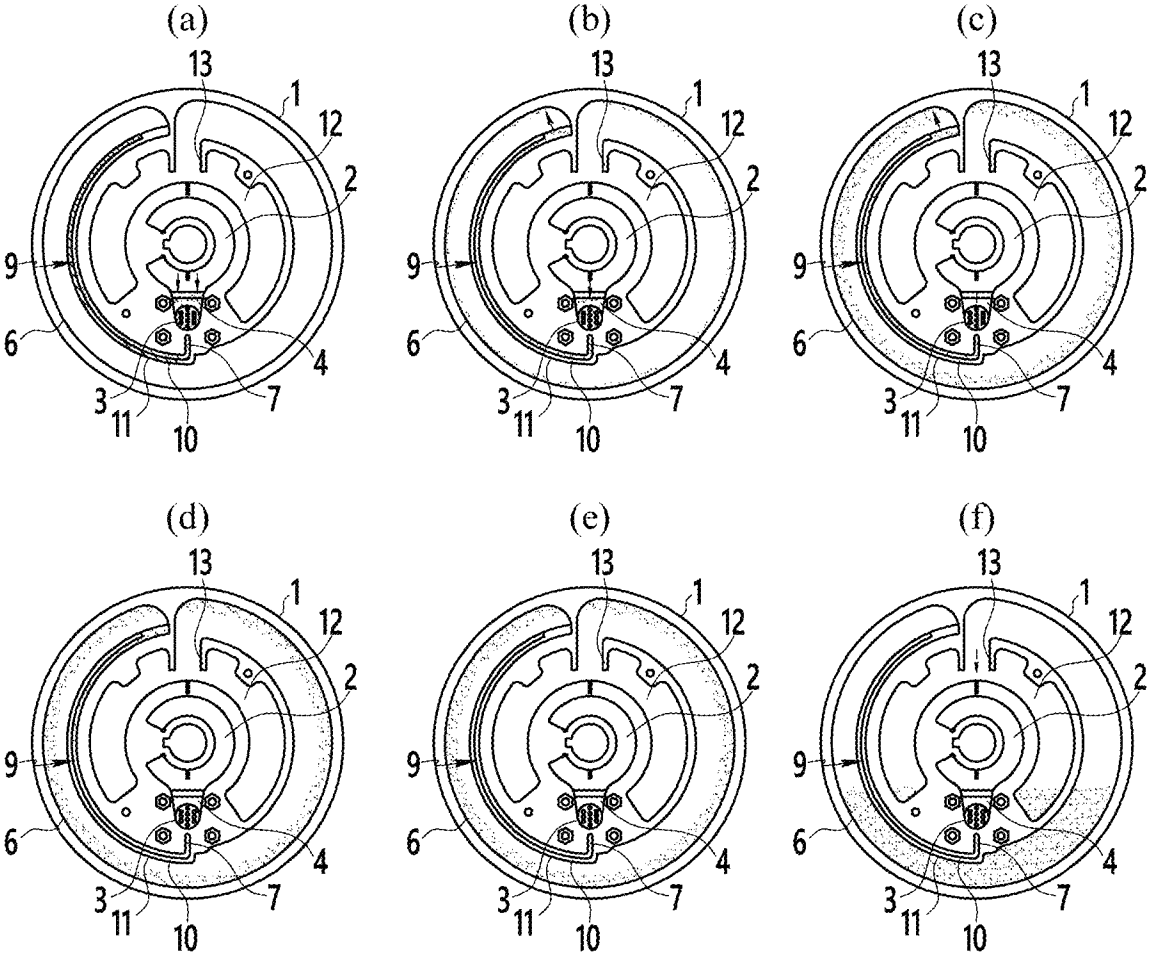
FIG. 5 is a schematic view illustrating an exemplary behavior of fluid in a microfluidic device including a backflow prevention unit according to a second embodiment of the present invention.

FIG. 5 is a schematic view illustrating an exemplary behavior of the fluid 9 in a microfluidic device including a backflow prevention unit according to a second embodiment of the present invention.

When the fluid 9 is injected into the first chamber 2 and then the microfluidic device is rotated, the fluid 9 is transferred to the second chamber 6 through the first micro flow channel 7 and the second micro flow channel 10. The second micro flow channel 10 may have a shape in which a direction in which the fluid 9 flows in from the first micro flow channel 7 to the second micro flow channel 10 and a direction in which the fluid 9 flows out from the second micro flow channel 10 to the second chamber 6 are different with respect to a flow direction of the fluid 9. In order to sufficiently obtain a backflow prevention effect, the larger the difference between the two directions, the better. Specifically, an angle formed by the direction in which the fluid 9 flows in from the first micro flow channel 7 to the second micro flow channel 10 and the direction in which the fluid 9 flows out from the second micro flow channel 10 to the second chamber 6 may be more than 0° and less than or equal to 180°. More specifically, the angle may be equal to or more than 30° and equal to or less than 180°; equal to or more than 30° and equal to or less than 150°; or equal to or more than 90° and equal to or less than 180°. FIG. 5 shows a case where the angle formed by the two directions is about 180°.

The fluid is transferred to the second chamber 6 through an outlet of the second micro flow channel 10 via the second micro flow channel 10. When the fluid 9 moves from the first chamber 2 to the second chamber 6 due to the rotation of the microfluidic device, the fluid 9 is continuously transferred as shown in FIGS. 4(*a*), (*b*), (*c*), and (*d*), and finally transfer and filtration may be completed as shown in FIG. 4(*e*). After the completion of the transfer, the device may be tilted due to an unexpected situation when operating the microfluidic device for other operations. In such a situation, the flow of the fluid 9 from the second chamber 6 to the second micro flow channel 10 may be totally blocked due to the wall 11 having no permeability to the fluid 9 positioned between the second micro flow channel 10 and the second chamber 6. Therefore, it is possible to prevent backflow of the fluid in a direction of the first chamber 2.

Also, in the case where the volume of the transferred and filtered fluids is large, since a meniscus position of the fluid in the second chamber 6 is high when the microfluidic device is tilted after completion of the transfer, a solution may be injected through the outlet of the second micro flow channel 10. This problem may also be solved through the wall 11 positioned between the first micro flow channel 7 and the second chamber 6. Specifically, when the device is tilted, only a small amount of the fluid 9 is transferred from the second chamber 6 to the first micro flow channel 7, thereby lowering the position of the meniscus and preventing backflow.

The second micro flow channel 10 may be equal to or more than 10 mm, and equal to or less than 50 mm. The length of the wall 11 may be equal to or more than 0.5 mm and equal to or less than 50 mm. However, the present invention is not limited thereto, and the lengths of the second micro flow channel 10 and the wall 11 may be appropriately adjusted.

And the length of the wall 11 may be equal to or more than 0.5 mm and equal to or less than 50 mm. The backflow of the fluid 9 transferred and filtered in this range may be effectively prevented. However, this may be appropriately adjusted according to a size of the microfluidic device.

The diameter of the second micro flow channel 10 may be equal to or more than 0.01 mm and equal to or less than 100 mm. When a diameter of the second micro flow channel 10 is too small, the flow resistance becomes large and thus a large pressure is required to induce the fluid flow, which may lead to instability of the fluid flow and cause a problem in a reduction in the filtration efficiency.

In the second embodiment, as shown in FIGS. 4 and 5, the microfluidic device may further include a third chamber 12 positioned in a direction of the center of the body 1 from the second chamber 6, and connected to the second chamber 6.

By providing the third chamber 12 positioned in the center of the body 1 rather than the third chamber 6, the fluid 9 may be transferred to and stored in the third chamber 12 when the microfluidic device is tilted. Thus, the fluid throughput of the microfluidic device may be increased.

The third chamber 12 may also further include a structure 13 protruding in a direction of the inside of the third chamber 12 at one end portion to which the third chamber 12 and the second chamber 6 are connected. By providing the structure 13 protruding in the direction of the inside of the third chamber 12, it is possible to prevent the transferred fluid 9 from being transferred to the second chamber 6 again when the microfluidic device is tilted or re-rotated. Therefore, the backflow prevention effect of the microfluidic device may be further improved, and the fluid throughput may be further increased The fluid to be processed through the microfluidic device may include blood, urine, saliva, or a combination thereof.

Third Embodiment

The backflow prevention unit of the third embodiment may include a fourth chamber 15 positioned between the first chamber 2 and the second chamber 6 and blocked from outside air; a third micro flow channel 16 positioned between the first chamber 2 and the fourth chamber 15 and a fourth micro flow channel 17 positioned between the fourth chamber 15 and the second chamber 6.

Figure 6:
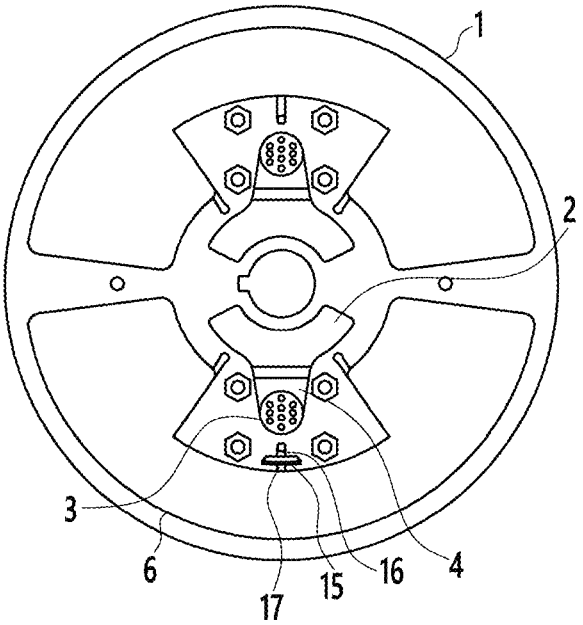
FIG. 6 is a cross-sectional view of a microfluidic device including a backflow prevention unit according to a third embodiment of the present invention.
Figure 7:
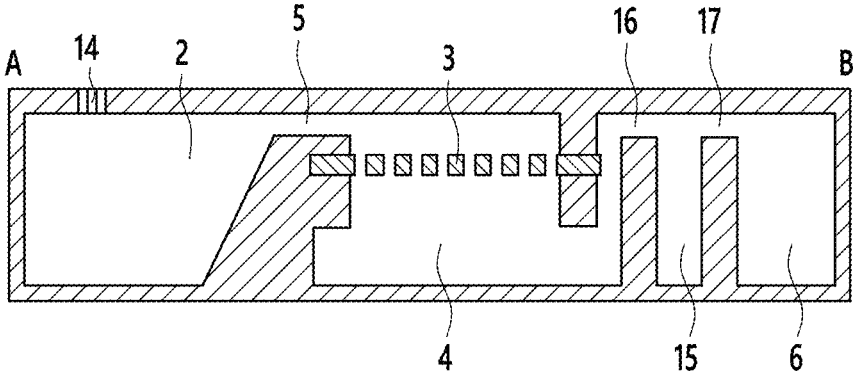
FIG. 7 is a longitudinal sectional view of a microfluidic device including a backflow prevention unit according to a third embodiment of the present invention.

FIG. 6 is a cross-sectional view of a microfluidic device including a backflow prevention unit according to a third embodiment. FIG. 7 is a longitudinal sectional view of the microfluidic device including the backflow prevention unit according to the third embodiment of FIG. 6 between points A and B.

The microfluidic device may be a rotatable structure with respect to the center of the device. Also, a shape of the structure may have various shapes such as a cylindrical shape, a square column shape, and the like. More preferably, the shape of the structure may be cylindrical.

As shown in FIGS. 6 and 7, in the microfluidic device according to the third embodiment, centrifugal force is generated when the device is rotated through a rotation center, thereby transferring fluid from the first chamber 2 to the second chamber 6.

The fourth chamber 15 may be in the form of a column in a direction perpendicular to a fluid flow direction in the third micro flow channel 16 and the fourth micro flow channel 17. The fourth chamber 15 in the form of the column may have a thickness of more than 0 mm, and equal to or less than 10 mm.

The second chamber 6 may include an air hole connected to the outside air, though not shown in the figure. Thus, fluid transfer from the first chamber 2 to the second chamber 6 may be facilitated when the device is rotated. During the fluid transfer, since the fourth chamber 15 is blocked from the outside air, a certain volume of air is trapped while the fluid is being transferred. When the fluid is transferred, the entirety of the fourth chamber 15 may not be completely filled with fluid due to the trapped air.

Further, even after the transfer of the fluid is completed and rotation of the microfluidic device is stopped, since the capillary force acts at outlets of the third micro flow channel 16 and the fourth micro flow channel 17, the fluid is stopped and remains in the third micro flow channel 16 and the fourth micro flow channel 17.

Due to such fluids in a stop state, the fourth chamber 15 is formed with a closed structure, and an air communicating path disappears in the fourth chamber 15. Due to lack of an air ventilation passage in the fourth chamber 15, a large pressure is required for fluid to flow into the fourth chamber 15 from the fourth micro flow channel 17. This allows the microfluidic device to withstand the hydrostatic pressure that may occur after the device is rotated or tilted after rotation, and a transferred sample does not flow back toward the first chamber 2.

Figure 8:
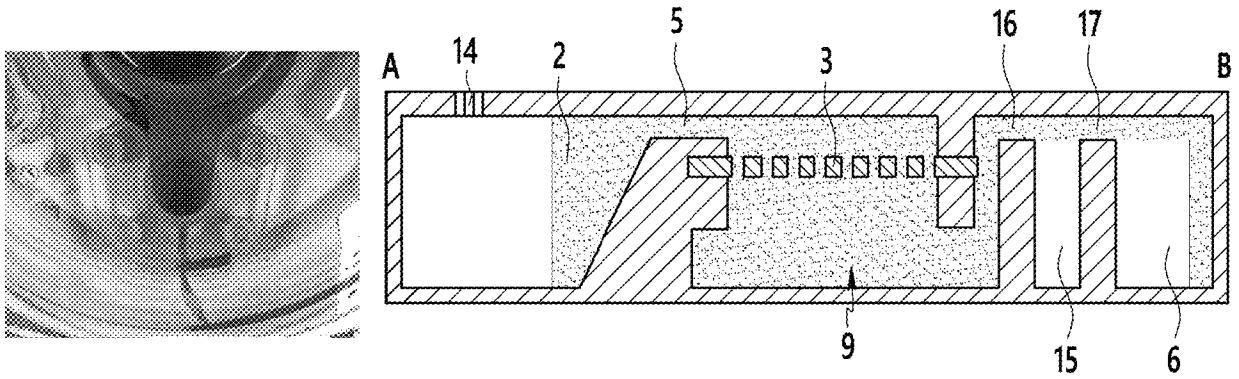
FIG. 8 is a photograph during a fluid filtration process through a microfluidic device including a backflow prevention unit according to a third embodiment of the present invention and a schematic view of a behavior of fluid.
Figure 9:
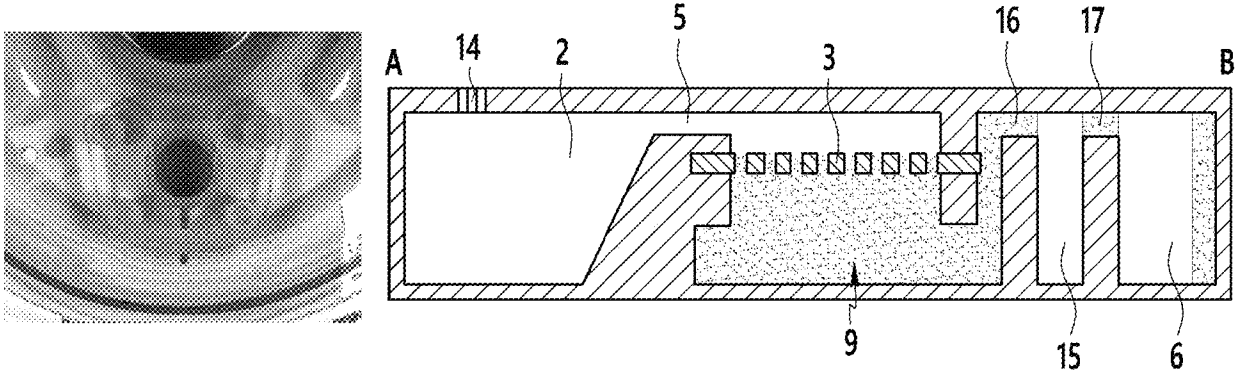
FIG. 9 is a photograph after fluid filtration through a microfluidic device including a backflow prevention unit according to a third embodiment of the present invention and a schematic view showing a state of a stopped fluid.

FIG. 8 is a photograph during a blood filtration process through a microfluidic device including a backflow prevention unit according to a third embodiment and a schematic cross-sectional view of a fluid flow. FIG. 9 is a photograph after blood filtration through a microfluidic device including a backflow prevention unit according to a third embodiment and a schematic cross-sectional view of a stopped fluid.

As shown in FIG. 8, when the microfluidic device rotates, the fluid 9 is transferred from the first chamber 2 to the second chamber 6. Although not shown, since the second chamber 6 is provided with a ventilation hole, the fluid 9 may be smoothly conveyed. Also, while the fluid 9 is being conveyed, since a certain volume of air is trapped in the fourth chamber 15 in which no vent is provided, the entirety of the fourth chamber 15 is not filled with the fluid 9.

As shown in FIG. 9, after the completion of transfer of the fluid 9, the rotation of the microfluidic device stops, and then a capillary force acts at outlets of the third micro flow channel 16 and the fourth micro flow channel 17, the fluid 9 remains in the third micro flow channel 16 and the fourth micro flow channel 17. Due to the remaining fluids 9, the fourth chamber 15 is formed with a closed structure, and an air communicating path disappears in the fourth chamber 15. As a result, a large pressure is required for the fluid 9 to flow into the fourth chamber 15, and thus the microfluidic device may withstand the hydrostatic pressure that may occur after the device is rotated or tilted after rotation, and the conveyed fluid does not flow back toward the first chamber 2.

Diameters of the third micro flow channel 16 and the fourth micro flow channel 17 may be equal to or more than 0.01 mm and equal to or less than 100 mm. If the diameter is too small, the flow resistance becomes large and a large pressure is required to induce the fluid flow, which may lead to instability of the fluid flow and cause a problem of a reduction in the filtration efficiency.

The fluid to be processed through the microfluidic device may include blood, urine, saliva, or a combination thereof.

The backflow prevention structures of the first to third embodiments may be optionally combined with two or more. Hereinafter, the microfluidic device in the case where a backflow prevention unit of the second embodiment and/or the first embodiment is combined with a backflow prevention unit of the third embodiment will be described.

Figure 10:
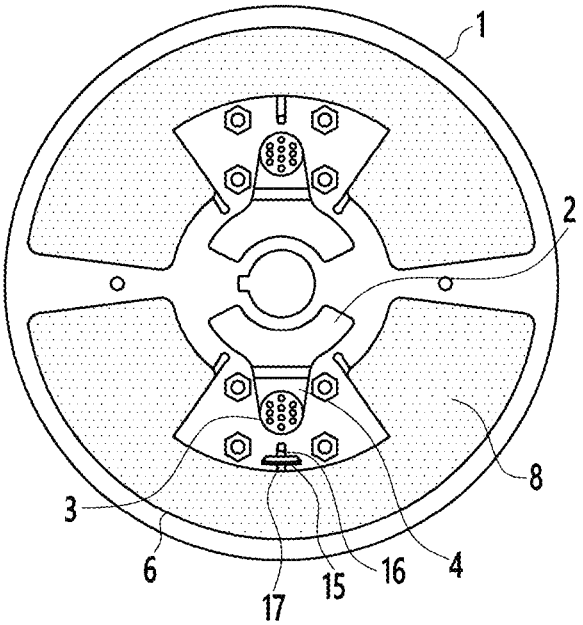
FIG. 10 is a cross-sectional view of a microfluidic device in which backflow prevention units of the third embodiment and the first embodiment are combined.

FIG. 10 is a cross-sectional view of a microfluidic device in which backflow prevention units of the third embodiment and the first embodiment are combined. The backflow prevention units of the third embodiment and the first embodiment are combined such that the microfluidic device of the third embodiment may include the moisture absorbent 8 capable of absorbing fluid in the second chamber 6. Other specific descriptions of the third embodiment and the first embodiment are as described above. Two configurations are combined such that each of the backflow prevention units may independently perform a backflow prevention function. Therefore, a backflow prevention effect may be further maximized.

Figure 11:
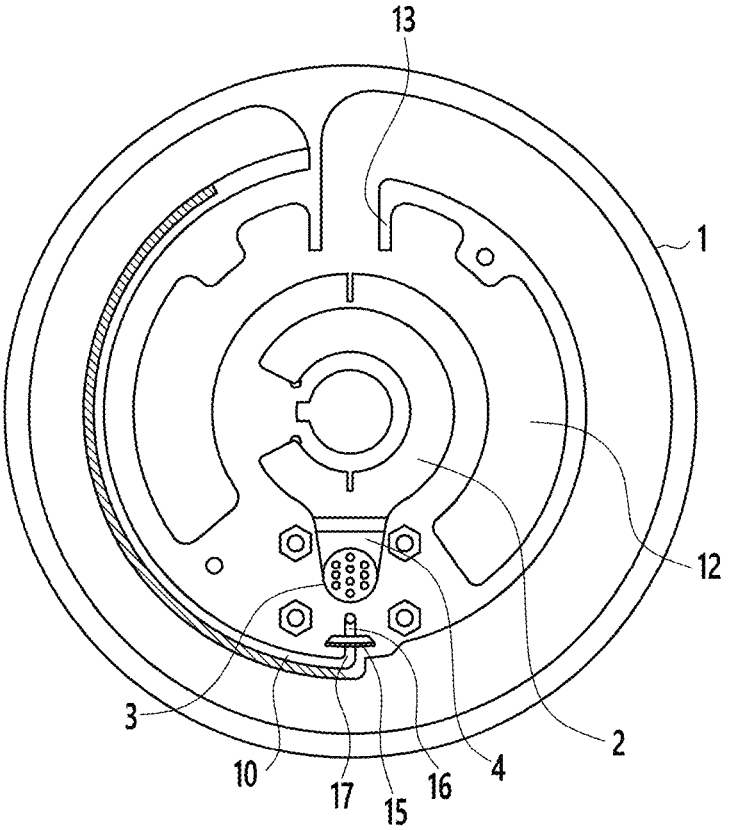
FIG. 11 is a cross-sectional view of a microfluidic device in which backflow prevention units of the third embodiment and the second embodiment are combined.

FIG. 11 is a cross-sectional view of a microfluidic device in which backflow prevention units of the third embodiment and the second embodiment are combined. The backflow prevention units of the third embodiment and the second embodiment are combined such that the microfluidic device of the third embodiment includes the second micro flow channel 10 disposed between the fourth micro flow channel 17 and the second chamber 6 and connecting the fourth micro flow channel 17 and the second chamber 6. The second micro flow channel 10 has a shape in which a direction in which the fluid flows in from the fourth micro flow channel 17 to the second micro flow channel 10 and a direction in which the fluid flows out from the second micro flow channel 10 to the second chamber 6 are different with respect to a flow direction of the fluid. The wall 11 having no permeability to the fluid may be positioned between the second micro flow channel 10 and the second chamber 6.

Other specific descriptions of the third embodiment and the second embodiment are as described above. Two configurations are combined such that each of the backflow prevention units may independently perform a backflow prevention function. Therefore, a backflow prevention effect may be further maximized.

Also, when the moisture absorbent is provided in the second chamber 6 as in the first embodiment, a backflow prevention effect may be further improved.

The exemplary embodiments and modified examples of the present invention have been described and shown with reference to the accompanying drawings, but the present invention is not limited to the exemplary embodiments and may be manufactured in various forms. As described above, it will be appreciated by those skilled in the art that changes may be made in these embodiments without departing from the principles and spirit of the general inventive concept, the scope of which is defined in the appended claims and their equivalents. Therefore, it should be understood that the exemplary embodiments described above are not limitative but are exemplary in all the aspects.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A microfluidic device comprising:

a body rotatable around a center of the body and having a first wall and a second wall; and a first chamber, a second chamber and a backflow prevention unit disposed between the first wall and the second wall in the body, wherein the first wall is disposed nearer from the center of the body than the second wall, wherein the first chamber is nearer to the first wall than the second chamber and the second chamber is nearer to the second wall than the first chamber, wherein a fluid is transferred from the first chamber to the second chamber, wherein the backflow prevention unit prevents a backflow of the fluid, which is a flow from the second chamber to the first chamber, wherein the backflow prevention unit is a moisture absorbent filling the second chamber, the moisture absorbent is capable of absorbing a filtered fluid, wherein the second chamber has an end portion protruding toward the center of the body, and the moisture absorbent fills the second chamber including the end portion.

2. The microfluidic device of claim 1, wherein:

the moisture absorbent is in a form of powder, and fixed to a support.

3. The microfluidic device of claim 2, wherein:

in the second chamber, the moisture absorbent fixed to the support is stacked.

4. The microfluidic device of claim 3, wherein:

the support includes polyethylene, polyester, nylon or a combination thereof.

5. The microfluidic device of claim 1, wherein:

the moisture absorbent includes natural fibers, acrylonitrile, silica gel, calcium chloride, acrylamide, or combinations thereof.

6. The microfluidic device of claim 1, wherein:

the body is a cylindrical structure rotatable with respect to a center.

7. The microfluidic device of claim 1, wherein:

the second chamber includes an air hole connected to outside air.

* * * * *